US005586396A

United States Patent [19]

Kanai

[11] Patent Number: 5,586,396

[45] Date of Patent: Dec. 24, 1996

[54] DRYING APPARATUS HAVING ROTATING VANE ASSEMBLIES AND DRYING METHOD USING THE SAME

[76] Inventor: Masao Kanai, 18-10 Nagatasannoudai, Minami-ku, Yokohama-shi, Japan

[21] Appl. No.: 512,375

[22] Filed: Aug. 8, 1995

[30] Foreign Application Priority Data

| | | | |
|---|---|---|---|
| Aug. 10, 1994 | [JP] | Japan | 6-209246 |
| Sep. 1, 1994 | [JP] | Japan | 6-232096 |
| Oct. 13, 1994 | [JP] | Japan | 6-013805 U |

[51] Int. Cl.[6] ..... F26B 17/30

[52] U.S. Cl. ..... 34/59; 34/61; 34/182; 416/223 B

[58] Field of Search ..... 34/58, 59, 60, 34/61, 182; 110/227, 228, 247, 258; 416/223 B

[56] References Cited

U.S. PATENT DOCUMENTS

| | | | |
|---|---|---|---|
| 4,130,944 | 12/1978 | Hultsch et al. | 34/58 X |
| 4,565,015 | 1/1986 | Hundley, III | 34/182 |

*Primary Examiner*—John M. Sollecito

*Assistant Examiner*—Steve Gravini

*Attorney, Agent, or Firm*—Cushman Darby & Cushman IP Group of Pillsbury Madison & Sutro, LLP

[57] ABSTRACT

Disclosed is an improvement in a drying apparatus comprising a cylindrical drying vessel, the inner wall surface of which makes up a heat-transmitting surface, a heat-generating means encircling the cylindrical drying vessel, and at least one rotating vane assembly rotatably fixed in the cylindrical drying vessel. The rotating vane assembly has vane sections, which leave between their circumferential edges and the heat-transmitting surface of the hollow cylinder an annular space small enough to allow wet material to cross and contact the heat-transmitting surface without falling therein. Each vane section extends obliquely upward in the direction which is opposite to the rotating direction, and the circumferential edge of each vane section extends less than 360 degrees as viewed from the top. All vane sections when rotating bear material on their upper surfaces to raise and push material against the heat-transmitting surface under the influence of centrifugal force, thus causing it to continuously climb along the heat-transmitting surface for drying.

9 Claims, 19 Drawing Sheets

DRYING APPARATUS HAVING ROTATING VANE ASSEMBLIES AND DRYING METHOD USING THE SAME

BACKGROUND OF THE INVENTION:

1. Field of the Invention:

The present invention relates to a drying apparatus whose vane assemblies spiral and push material to be dried against its heat-transmitting surface, and a drying method using the same.

2. Description of Prior Arts:

There are a variety of drying apparatuses for drying different water-containing materials such as fluid material, semi-fluid material or pulverized material.

The applicant of the present application proposed a drying apparatus in Japanese Utility Model Application Laid-Open No. 3-19501. It comprises a cylindrical drying vessel to put material to be dried therein, the inner wall surface of which cylindrical drying vessel makes up a heat-transmitting surface, a heat-generating means encircling the cylindrical drying vessel to transmit heat to the heat-transmitting surface of the cylindrical drying vessel, and a screw-like rotating vane assembly rotatably fixed in the cylindrical drying vessel.

Specifically a rotating axle erects on the bottom of the cylindrical drying vessel, and the screw-like rotating vane assembly is fixed to the rotating axle by a plurality of radial arms, which extend across the material-falling space in the cylindrical drying vessel. After being raised up to the top level of the drying vessel and after being deprived of water content the dried material is allowed to fall in the material-falling space in the cylindrical drying vessel. There is an annular space between the outer vane circumference and the inner wall surface of the cylindrical drying vessel to allow the material to contact the heat-transmitting surface of the cylindrical drying vessel without falling down from the annular space.

In operation the material is spiralled by the rotating vane assembly until it is raised to the top level of the cylindrical drying vessel, then allowing the material to fall on, and again the material is spiralled and raised to the top level. On the way to the top level the material is pushed against the heat-transmitting surface under the influence of centrifugal force, and this up-and-down cyclic motion is repeated until the material has been dried.

This conventional drying apparatus, however, has following defects:

First, in case of drying a material of increased viscosity such sticky material is liable to adhere to the vane sections of the vertical rotary vane assembly and the heat-transmitting surface, thus agglomerating between adjacent upper and lower vane sections to impede the continuous rising of material to be dried. As a result the up-and-down cyclic motion is prevented, and hence unsatisfactory drying results.

Second, the annular space between the outer vane circumference and the inner wall surface of the cylindrical drying vessel extends upward in an elongated spiral form, and foreign substances in the material to be dried are liable to be caught somewhere in the elongated spiral gap, thus preventing rotation of the vertical spiral vane assembly.

Third, the screw-like rotating vane assembly is fixed to the rotating axle by radial arms, which extend across the material-falling space in the cylindrical drying vessel. String- or sheet-like foreign substance such as vinyl sheets when falling down, are likely to be caught by such radial arms, thereby preventing the smooth up-and-down cyclic movement of material in the cylindrical drying vessel.

Fourth, a single spiral vane assembly is used to raise the material to be dried, and therefore, only a limited amount of material can be conveyed for drying, compared with the material remaining on the bottom of the drying vessel, thus causing the lowering of drying efficiency.

Fifth, the areas of the heat-transmitting surface facing the space between adjacent upper and lower vane sections cannot be fully used by pushing material against such areas under the influence of centrifugal force. That is to say, the heat-transmitting surface cannot be fully used.

Sixth, the rotating speed of the spiral vane assembly must be varied with the kinds of material to be dried because otherwise, the cyclic up-and-down movement of material in the drying vessel cannot be caused so as to attain the best drying efficiency. It is, however, difficult to control the rotating speed of the spiral vane to attain the best drying efficiency.

SUMMARY OF THE INVENTION:

One object of the present invention is to provide a drying apparatus which is guaranteed free of: (1) adhering of sticky material to the rotating blades to lower the drying efficiency; (2) the catching of foreign materials in the annular gap formed between the heat-transmitting surface and the rotating blades; and (3) the catching of string- or sheet-like foreign material by the blade-supporting arms of the rotating vane assembly, and said drying apparatus providing advantages of: (4) increasing the ratio of the rising amount of material to the remaining amount of material; (5) making full use of the whole area of heat-transmitting surface; and (6) improving the drying efficiency without the necessity of controlling the rotating speed of the spiral blade assembly.

To attain this object a drying apparatus comprising a cylindrical drying vessel to put material to be dried therein, the inner wall surface of which cylindrical drying vessel makes up a heat-transmitting surface, a heat-generating means encircling the cylindrical drying vessel to transmit heat to the heat-transmitting surface of the cylindrical drying vessel, and at least one screw-like rotating vane assembly rotatably fixed in the cylindrical drying vessel, is improved according to the present invention in that the rotating screw-like vane assembly has a plurality of vane sections, which leave between their circumferential edges and the heat-transmitting surface of the cylindrical drying vessel an annular space small enough to allow the material to cross and contact the heat-transmitting surface, each vane section extending obliquely upward in the direction which is opposite to the rotating direction, and the circumferential edge of each vane section extending less than 360 degrees as viewed from the top, whereby when rotating all vane sections bear given amount of material on their upper surfaces to raise the material upward and at the same time, push the material against the heat-transmitting surface under the influence of centrifugal force, thus allowing the material to continuously rise along the heat-transmitting surface, thereby drying the material.

The cylindrical drying vessel may have a center rotating axle erecting on its bottom, and the center rotating axle may have a plurality of rotating screw-like vane assemblies at different levels, whereby all rotating screw-like vane assemblies when rotating may raise a relatively large amount of material level to level so that the material may be raised from the lowest to the highest level while pushing the material against the heat-transmitting surface, thereby drying the material.

With this arrangement a material to be dried is spiralled and pushed against the heat-transmitting surface of the drying vessel, and therefore, first, in case of drying a material of increased viscosity such sticky material is not liable to adhere to the rotating vane sections and the heat-transmitting surface, and even if such material adheres thereto, it is forcedly raised along the whole area of the heat-transmitting surface, and therefore, the material cannot be localized.

Second, the outer circumference of each vane section extends less than 360 degrees, and the annular space between the outer circumferences of all vane sections and the inner wall surface of the cylindrical drying vessel is continuous and small enough to prevent the biting of foreign substances in the material to be dried.

Third, there is no cyclic, up-and-down movement of the material to be dried, and therefore, there is no fear of catching string- or sheet-like foreign substance on the falling course to the bottom of the drying vessel.

Fourth, a plurality of vane sections are used in raising the material to be dried, and therefore, the ratio of the rising amount of material to the remaining material is increased, thus putting an increased amount of material in contact with the heat-transmitting surface, and accordingly increasing the drying efficiency.

Fifth, the following rising material pushes the preceeding rising material continuously upward, spreading the rising material over the extensive area of heat-transmitting surface so that the material thus spreaded extensively may be of so reduced thickness as to facilitate the transmitting of heat for efficient drying.

Sixth, the rising material can be pushed against the heat-transmitting surface with an increased force by increasing the rotating speed of the spiral vane assembly, thereby increasingly spreading the rising material over the extensive area of heat-transmitting surface to facilitate the drying of material.

Other objects and advantages of the present invention will be understood from the following description of drying apparatuses according to preferred embodiments of the present invention, which are shown in accompanying drawings.

Figure 1:
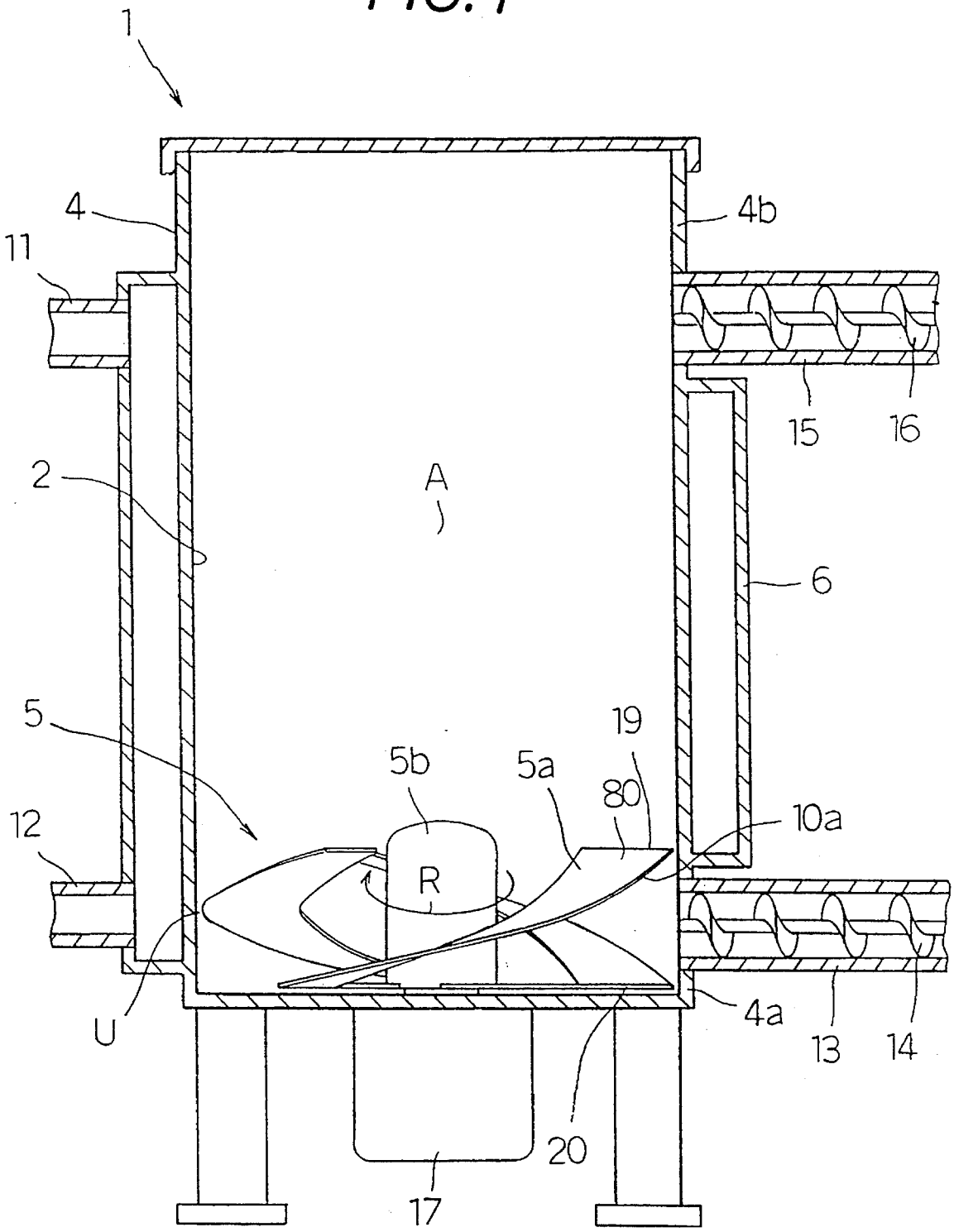
FIG. 1 is a longitudinal section of a single-stage drying apparatus having a single rotating vane assembly according to a first embodiment of the present invention.

DESCRIPTION OF PREFERRED EMBODIMENTS:

FIGS. 1 to 5 show a drying apparatus 1 according to a first embodiment of the present invention. It comprises a cylindrical drying vessel 4 to put material to be dried is therein, the inner wall surface of which cylindrical drying vessel 4 makes up a heat-transmitting surface 2, a heat-generating means 6 encircling the cylindrical drying vessel 4 to transmit the heat to the heat-transmitting surface 2 of the cylindrical drying vessel 4, and a screw-like rotating vane assembly 5 rotatably fixed to the bottom of the cylindrical drying vessel 4. The cylindrical drying vessel 4 has a material feeding pipe 13 fixed to its cylindrical wall at a level close to the bottom of the hollow cylinder 4, and a material discharging pipe 15 fixed to its cylindrical wall at a level close to the ceiling of the cylindrical vessel 4. The material feeding pipe 13 has a spiral conveyor 14 therein for driving a controlled amount of material to be dried into the lower part 4*a* of the drying vessel 4 whereas the material discharging pipe 15 has a spiral conveyor 16 therein for removing the raised-and-dried material from the upper part 4*b* of the hollow cylinder 4, driving it to a storage (not shown). Also, the drying vessel 4 has an encircling jacket 6 as a heat-generating means. The encircling space defined by the jacket 6 communicates with an associated steam-generating boiler via upper outlet 11 and lower inlet 12.

As shown in FIG. 1, the screw-like rotating vane assembly 5 is rotatably fixed to the bottom 4*a* of the hollow cylinder 4, and its axle 5*b* is connected to an electric motor 17.

The screw-like rotating vane assembly 5 has a plurality of vane sections 5*a*, three vane sections 5*a* in this particular example. All vane sections 5*a* have a similar shape, extending obliquely in the direction which is opposite to the rotating direction R, leaving an annular space U between their outer circumferential edges 10*a* and the inner wall surface 2 of the hollow cylinder 4, which annular space U is small enough to prevent the falling of material. Each vane section has a flat surface 80 on its upper side.

Figure 2:
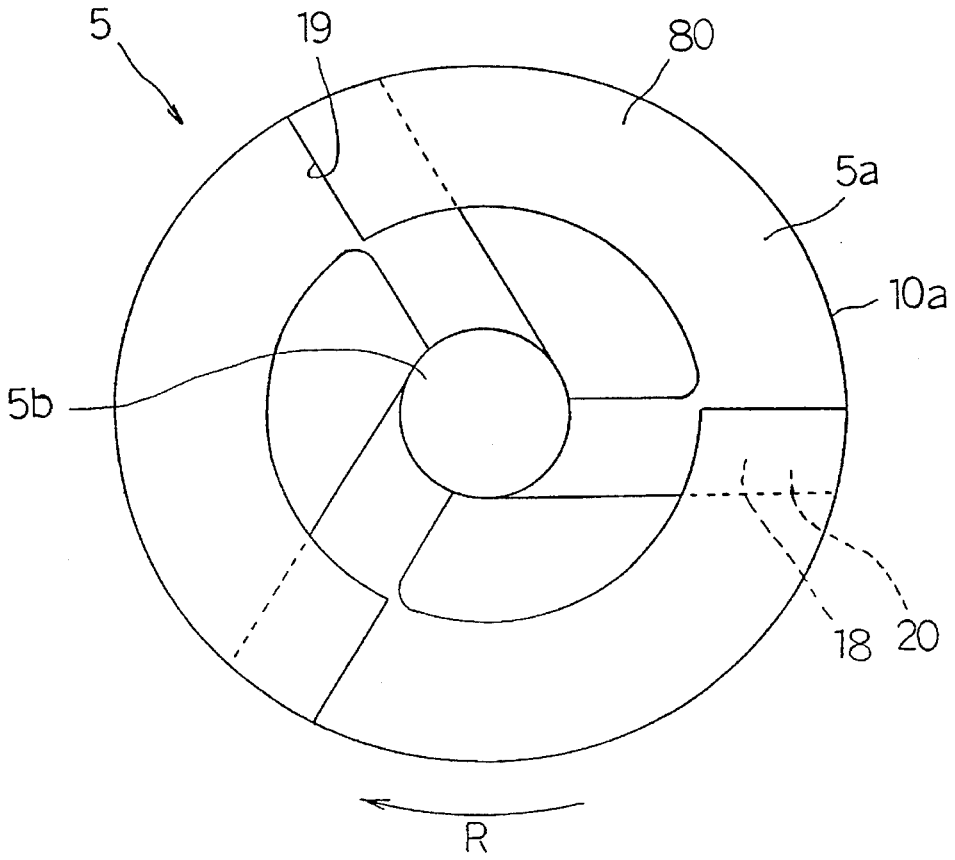
FIG. 2 is a plane view of a first type of rotating vane assembly having three spokes.
Figure 3:
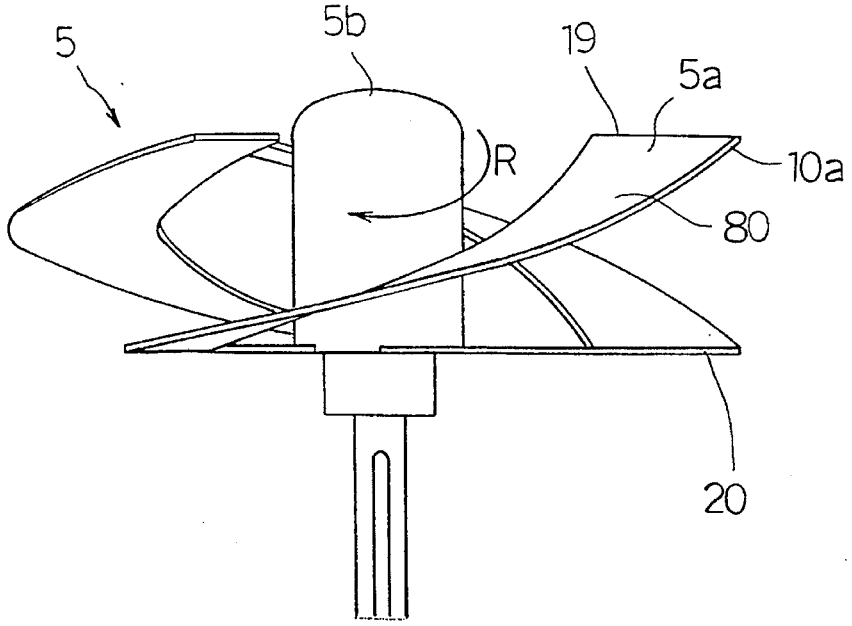
FIG. 3 is a side view of the rotating vane assembly.

As best seen from FIG. 2, each vane section 5*a* extends less than 360 degrees. Specifically the circular-arc length from one end 18 to the other end 19 of the vane section forms an angle which is less than 360 degrees with respect to the center of rotation. The lower end 18 of the vane section 5*a* functions as a scraper 20.

Another example of heat-generating means is composed of an encircling jacket 6 filled with heat medium, and an electric heater attached to the jacket 6, thereby permitting the heat generated by the electric heater to be transmitted to the heat-transmitting surface 2 of the hollow cylinder via the heat medium. Still another example of heat-generating means is an electric heater directly encircling the drying vessel.

In operation, first, the screw conveyor 14 is rotated to drive the material to be dried into the hollow cylinder 4, and at the same time, the electric motor 17 is made to start, thereby rotating the spiral vane assembly 5. Also, the steam generated by the boiler is directed to the encircling jacket 6 to heat the heat-transmitting surface 2 of the hollow cylinder 4.

The vane sections 5*a* of the rotating vane assembly 5 scrape material, pushing the so scraped amount of material upward along their inclined vane surfaces 80, causing it to move from the scraping end 18 to the rising end 19 of each vane section 5*a*. While the so scraped amount of material is rising, it is pushed against the heat-transmitting surface 2 of the hollow cylinder 4 under the influence of the centrifugal force P.

Figure 4:
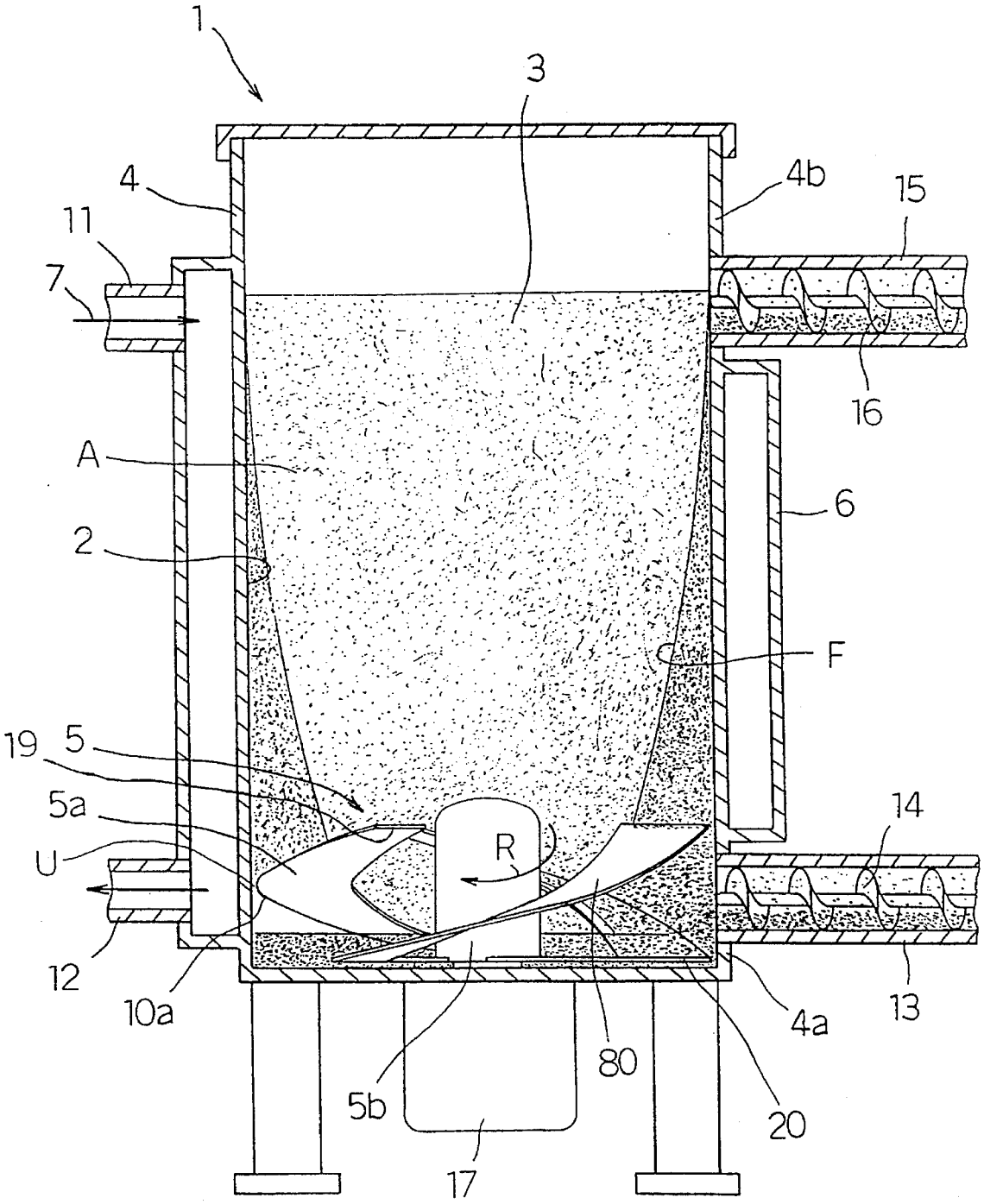
FIG. 4 is a longitudinal section of the single-stage drying apparatus, showing how it works.
Figure 5:
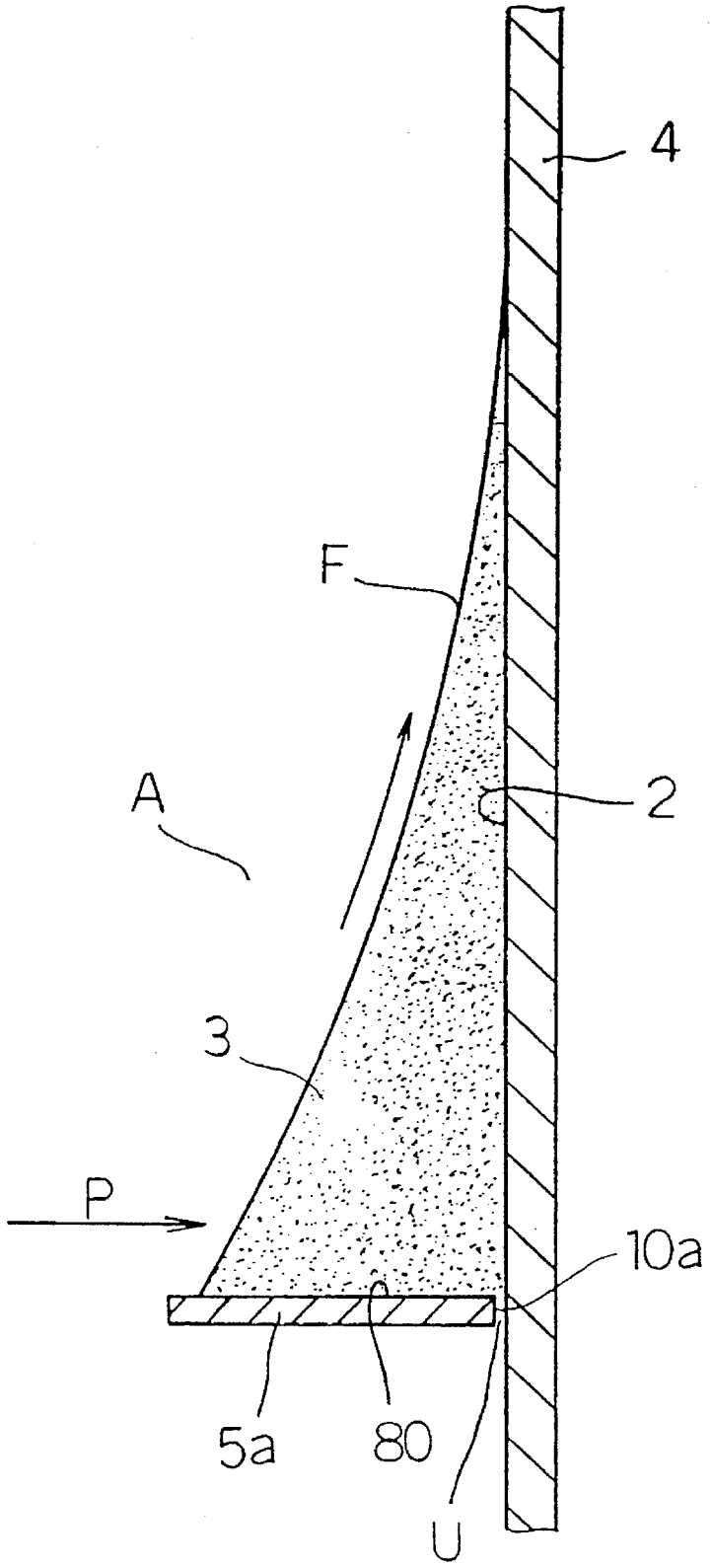
FIG. 5 is an enlarged view of a part of the single-stage drying apparatus, showing how wet material is dried.

As seen from FIG. 4, one side of the rising material mass 3 is pushed against the heat-transmitting surface 2 of the hollow cylinder 4 on one side, and the other side of the rising material mass 3 is exposed to the inner atmosphere A of the hollow cylinder 4 for evaporation. The material which contacts the heat-transmitting surface 2 of the hollow cylinder 4 is deprived of water by evaporation, and the so partly dried material moves toward the evaporation surface F to change the wet material in position. The partly dried material thus coming up to the evaporation surface F is exposed the hot environment A for evaporation.

While moving toward the evaporation surface F the following amount of material pushes the preceeding amount of material, climbing along the heat-transmitting surface 2.

While rotating the vane assembly, material leaves apart from the rising end 19 of the preceeding vane section 5*a*, and at the next moment the so leaving amount of material is about to fall, and then it strikes against the leaving amount of material from the following vane section, thus causing a turbulent flow there. In the turbulence zone material is accelerated to move at an increased speed to the heat-transmitting surface 2, thus causing the material to be positively driven to and pushed against the heat-transmitting surface 2 of the hollow cylinder 4, thereby expediting the drying of material. The turbulance zones can be increased with the increase of the number of vane sections 5*a* and the rotating speed of the vane assembly 5.

Dried material is conveyed from the hollow cylinder 4 by the spiral conveyor 16 for deposition in the storage.

Material to be dried may be intermittently fed to the hollow cylinder 4, and otherwise, it may be continuously fed to the hollow cylinder 4.

Figure 6:
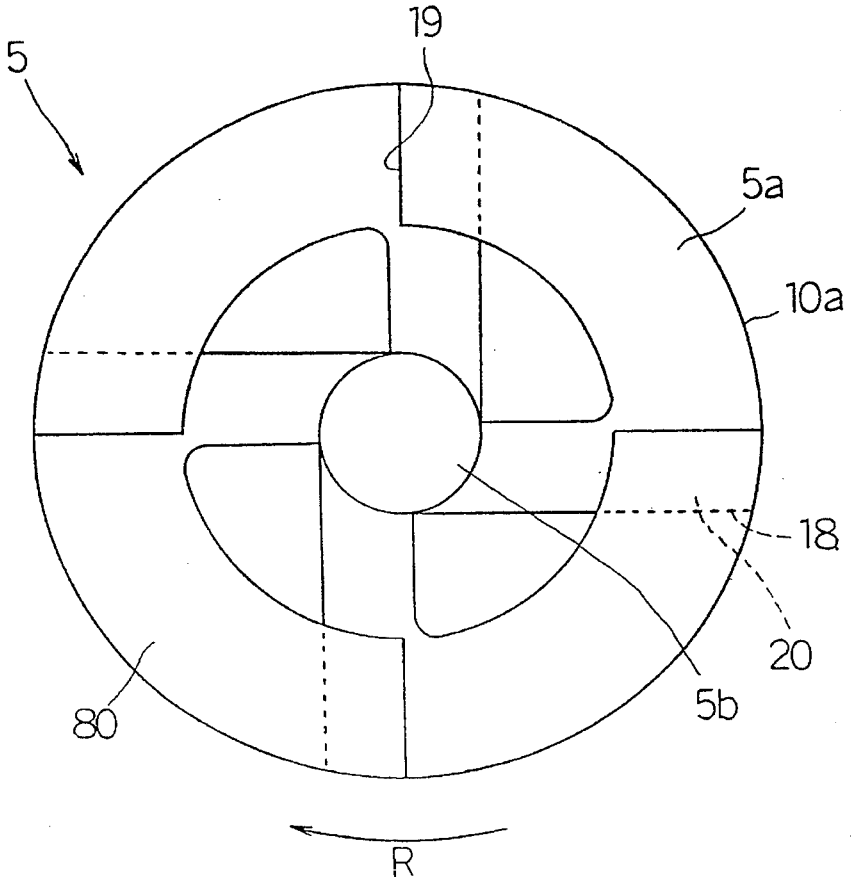
FIG. 6 is a plane view of a first type of rotating vane assembly having four spokes.
Figure 7:
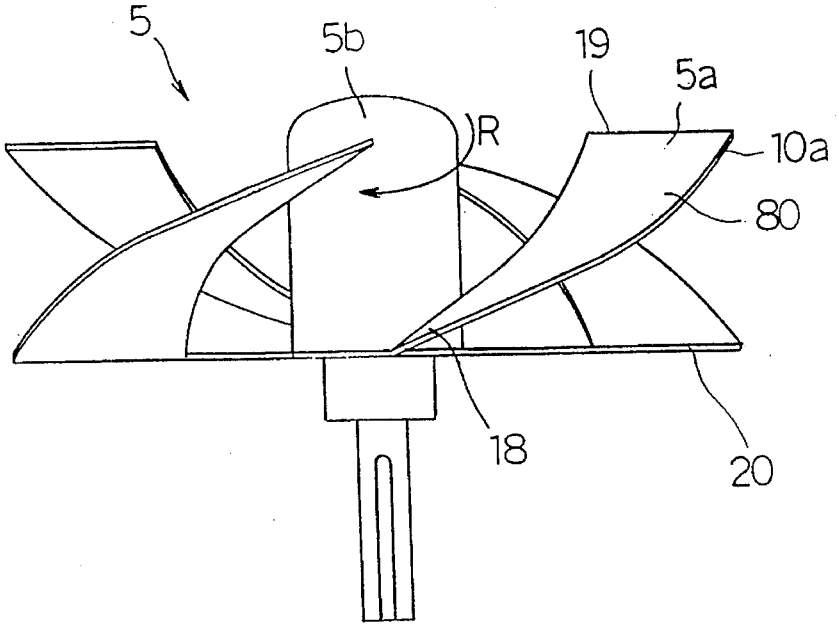
FIG. 7 is a side view of the rotating vane assembly of FIG. 6.

FIGS. 6 and 7 show a rotaing vane assembly having four radial arms and four vane sections 5*a*. Each vane section is circular-arc in shape, similar to the vane section in FIGS. 2 and 3.

Figure 8:
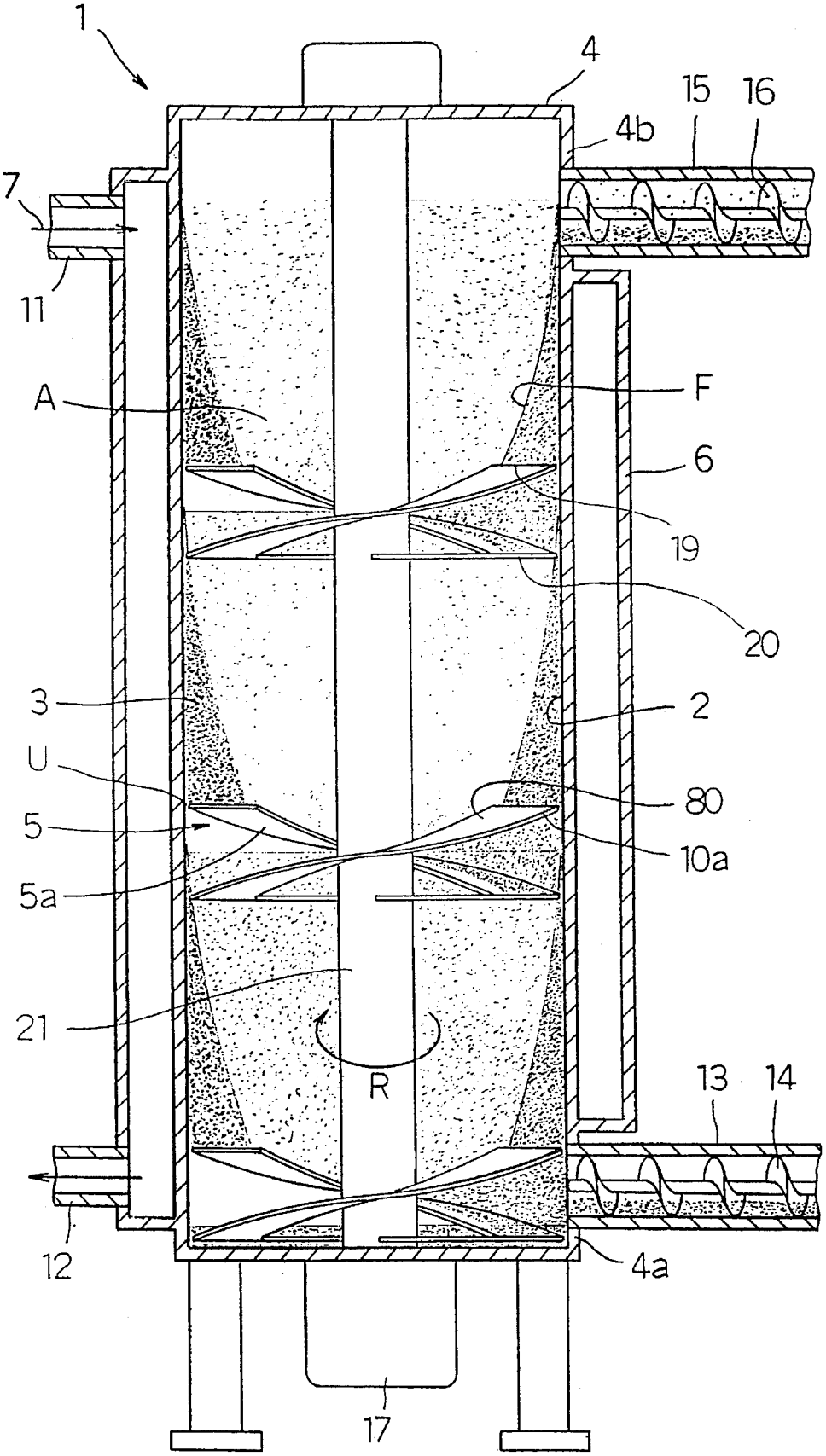
FIG. 8 is a longitudinal section of a multi-stage drying apparatus having a plurality of rotating vane assemblies at different levels according to a second embodiment of the present invention, showing how the drying apparatus works.
Figure 9:
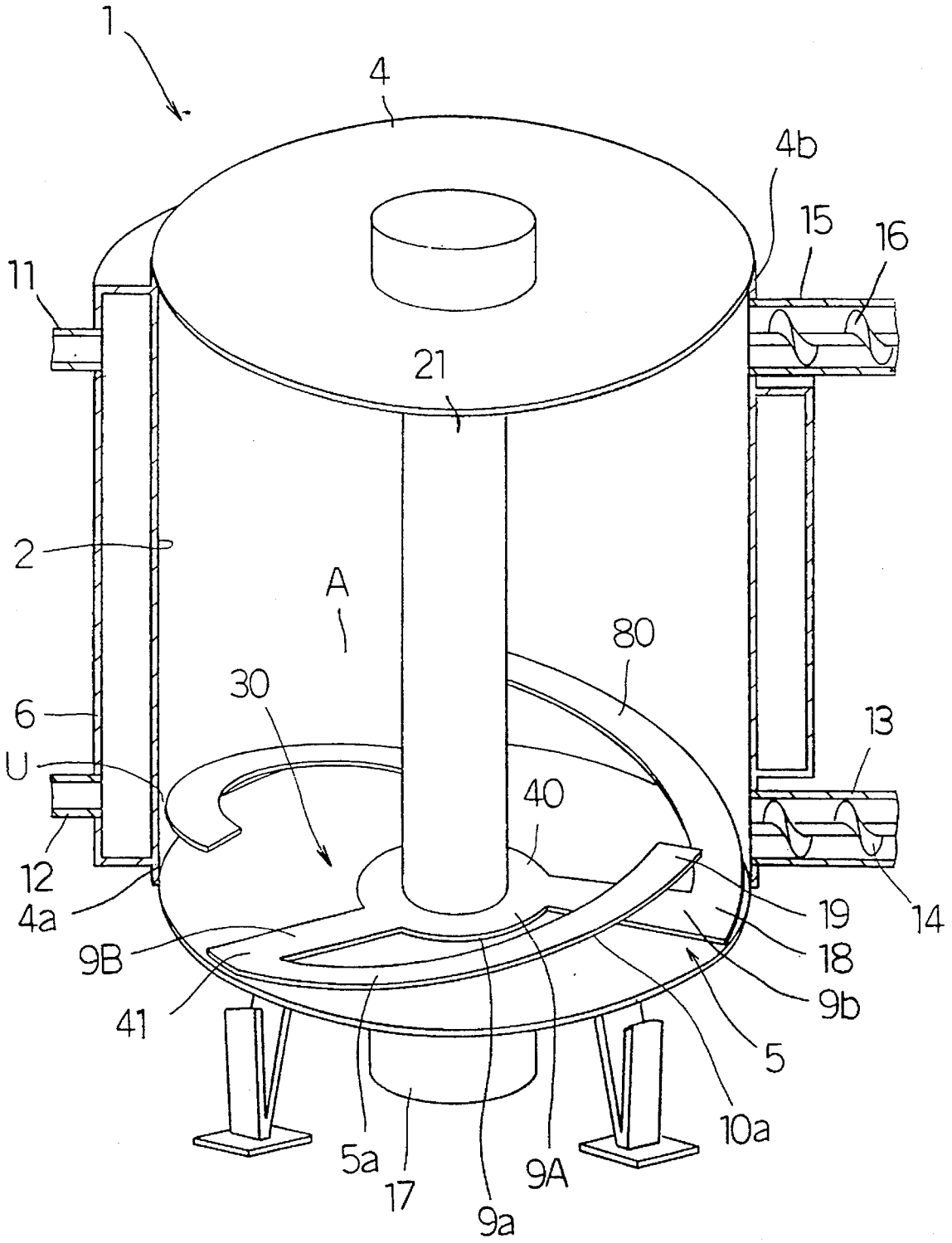
FIG. 9 is a perspective view of a single-stage drying apparatus according to a third embodiment of the present invention, shown partly in section.
Figure 10:
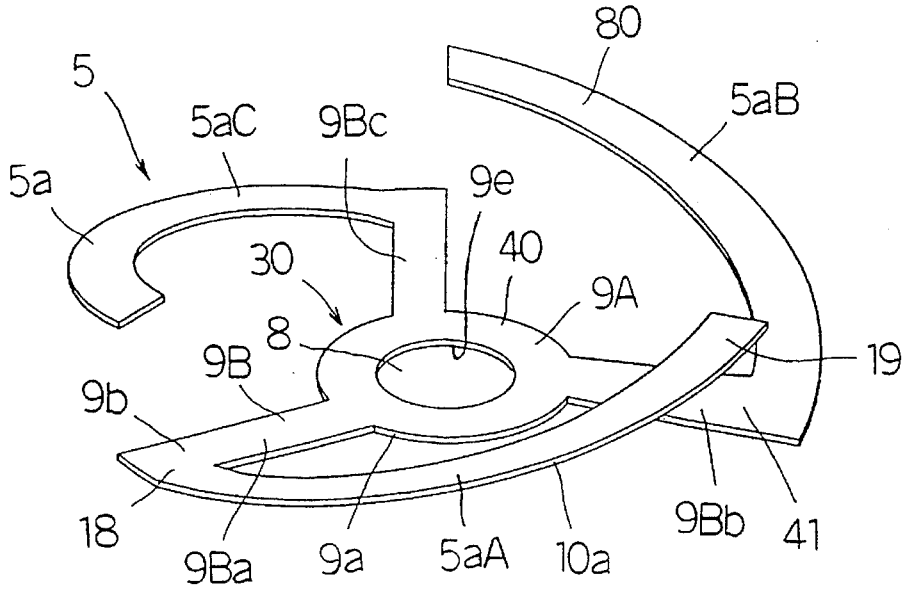
FIG. 10 is a perspective view of a second type of rotating vane assembly having three spokes.
Figure 11:
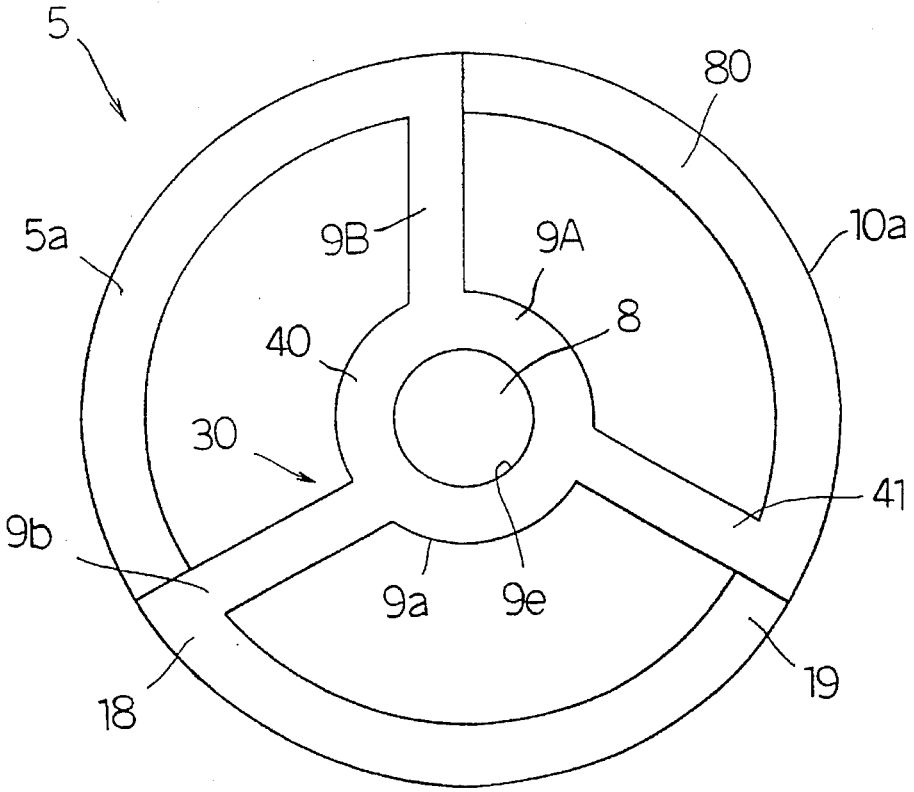
FIG. 11 is a plane view of the rotating vane assembly of FIG. 10.
Figure 12:
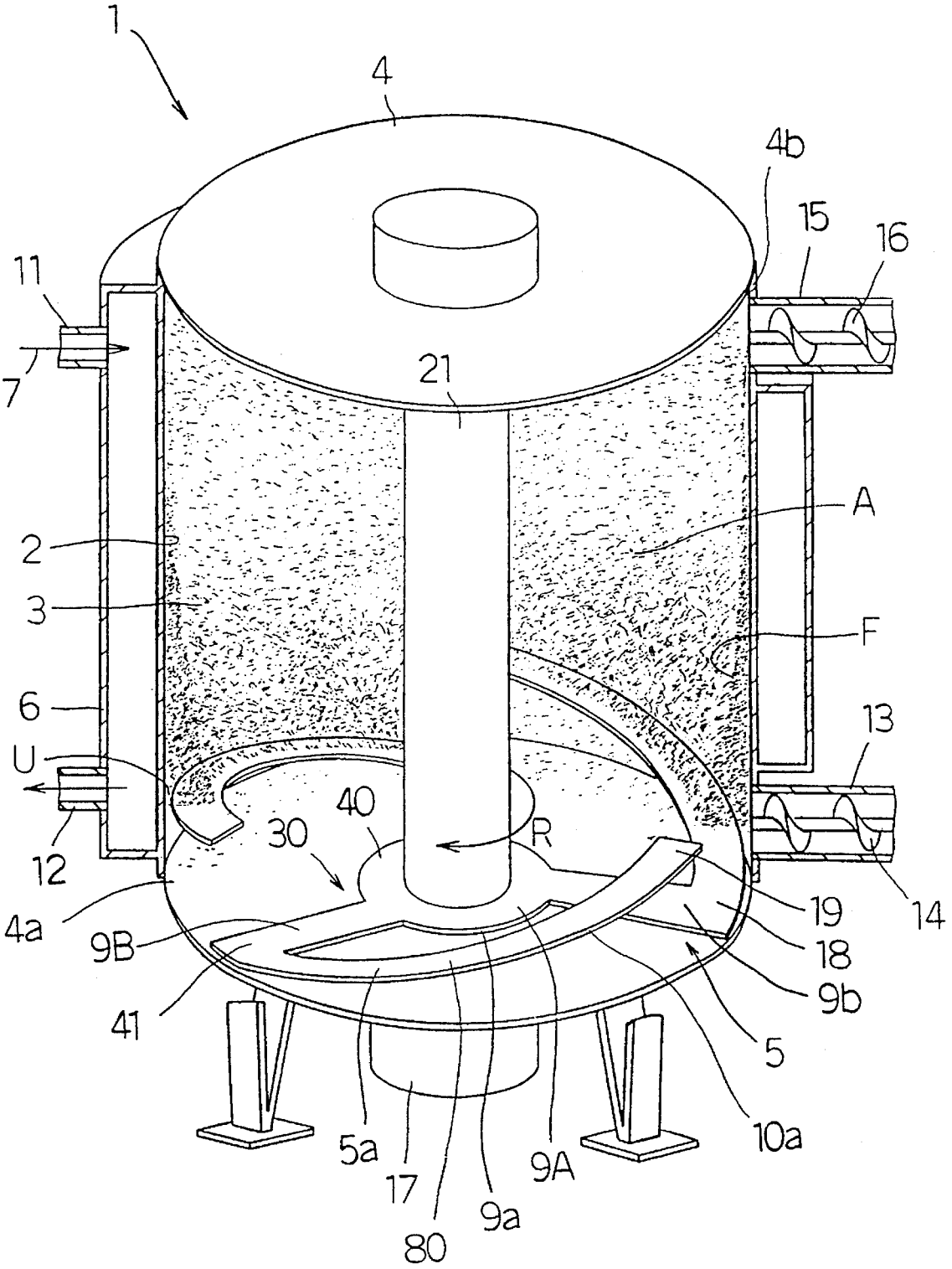
FIG. 12 is a longitudinal section of the single-stage drying apparatus of FIG. 9, showing how the drying apparatus works.

FIG. 8 shows a multi-stage drying apparatus having a plurality of vane assemblies 5 fixed to its axle 21 at different levels. Each vane assembly 5 has two radial arms and two vane sections 5*a*.

In operation steam 7 is supplied to the jacket 6 via the steam inlet 11 to leave from the steam outlet 12. The electric motor 17 is made to start to rotate the vertical axle 21 in the direction indicated by arrow R. The lowest rotating vane assembly scrapes material 3 which is brought to the bottom 4*a* of the hollow cylinder 4 by the spiral conveyor 14, and the so scraped material is pushed against the heat-transmitting surface 2 of the hollow cylinder 4, climbing therealong until the intermediate rotating vane assembly scrapes the rising material 3. Similarly the so scraped material is pushed against the heat-transmitting surface 2 of the hollow cylinder 4, climbing therealong until the highest rotating vane assembly scrapes the rising material 3, and the so scraped material is pushed against the heat-transmitting surface 2 of the hollow cylinder 4 again, climbing therealong upto the level 4*b* at which the outlet conduit opens in the hollow cylinder 4, and then the dried material is conveyed by the spiral conveyor 16 to the storage.

FIGS. 9 to 12 show another single-stage drying apparatus, which is different from the single-stage drying apparatus of FIGS. 1 to 5 in that it uses an elongated vertical axle 21 and a broken wheel-like vane assembly 5. Specifically, the elongated vertical axle 21 extends from the bottom 4*a* to the ceiling 4*b* of the hollow cylinder 4. As best seen from FIG. 10, the vane assembly 5 comprises a center disk 9A having an aperture 8 made therein, three radial arms 9Ba, 9Bb and 9Bc each integrally connected at one end to the circumference of the center disk 40 and three circular-arc vane sections 10*a* each integrally connected at one end to the radial arm 9B. As seen from FIGS. 9 and 10, each circular-arc vane section 5*a* extends obliquely upward.

The vertical elongated axle 21 passes through the aperture 8 of the ring 9A, and the inner circumference 9*e* of the aperture 8 of the ring 9A is connected to the outer circumference of the vertical elongated axle 21.

Figure 13:
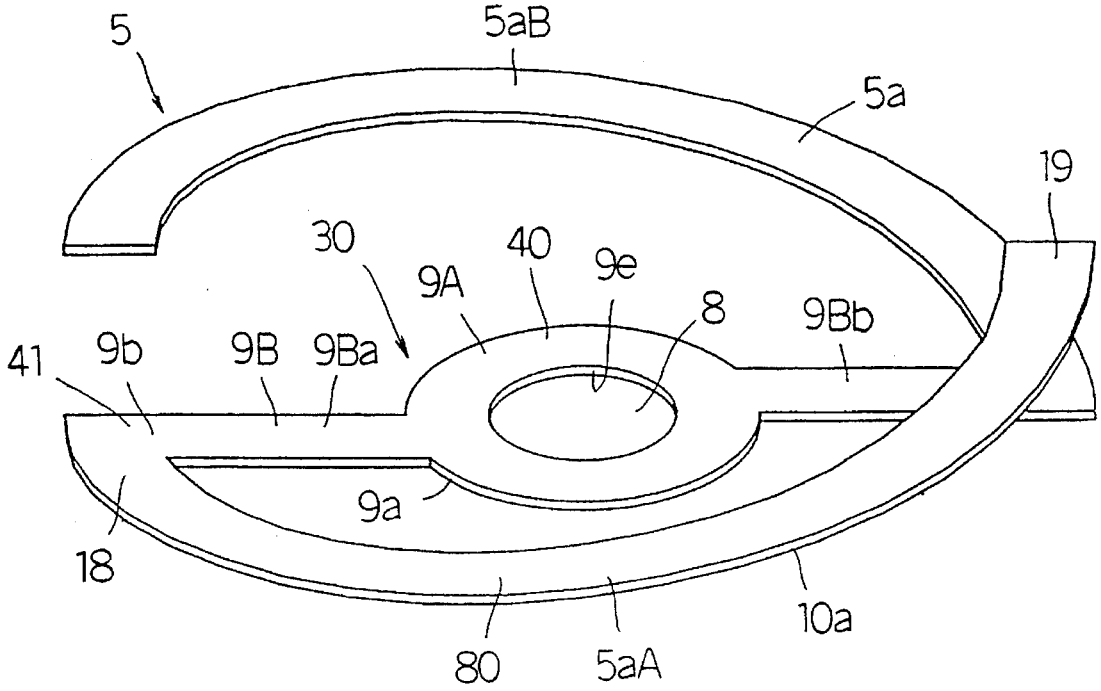
FIG. 13 is a perspective view of a second type of rotating vane assembly having two spokes.

Referring to FIG. 13, a vane assembly 5 comprises a center disk 40 having an aperture 8 made therein, two radial arms 9Ba and 9Bb each integrally connected at one end to the circumference of the ring 9A and two circular-arc vane sections 10*a* each integrally connected at one end to the radial arm 9B. As seen from the drawing, each circular-arc vane section 5aA or 5aB extends obliquely upward.

Figure 14:
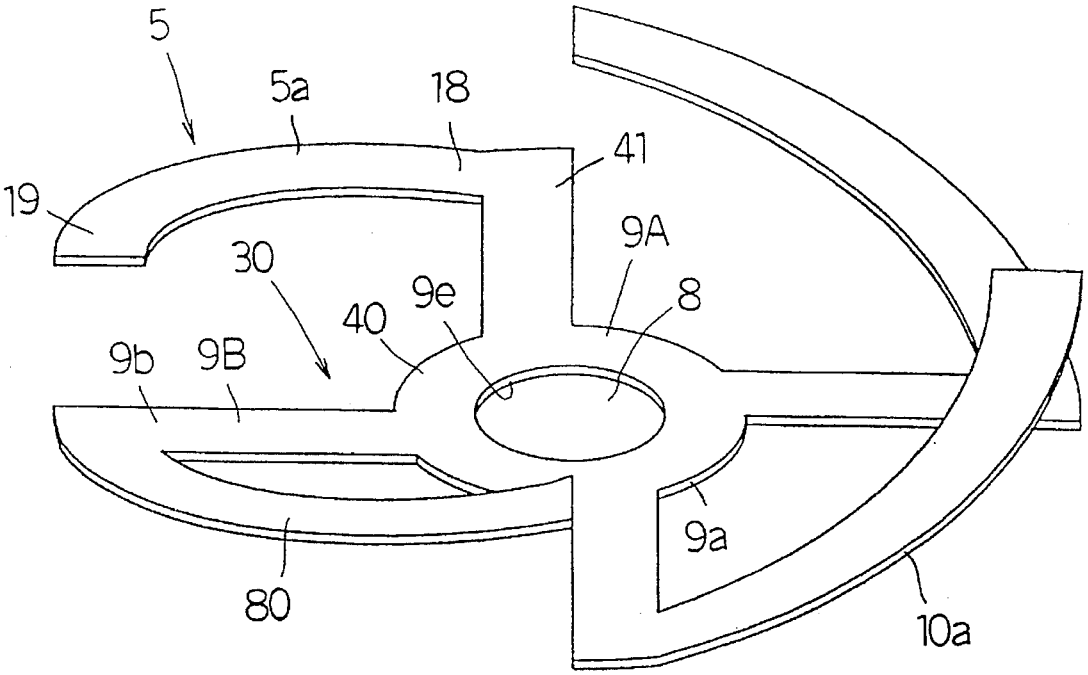
FIG. 14 is a perspective view of a second type of rotating vane assembly having four spokes.
Figure 15:
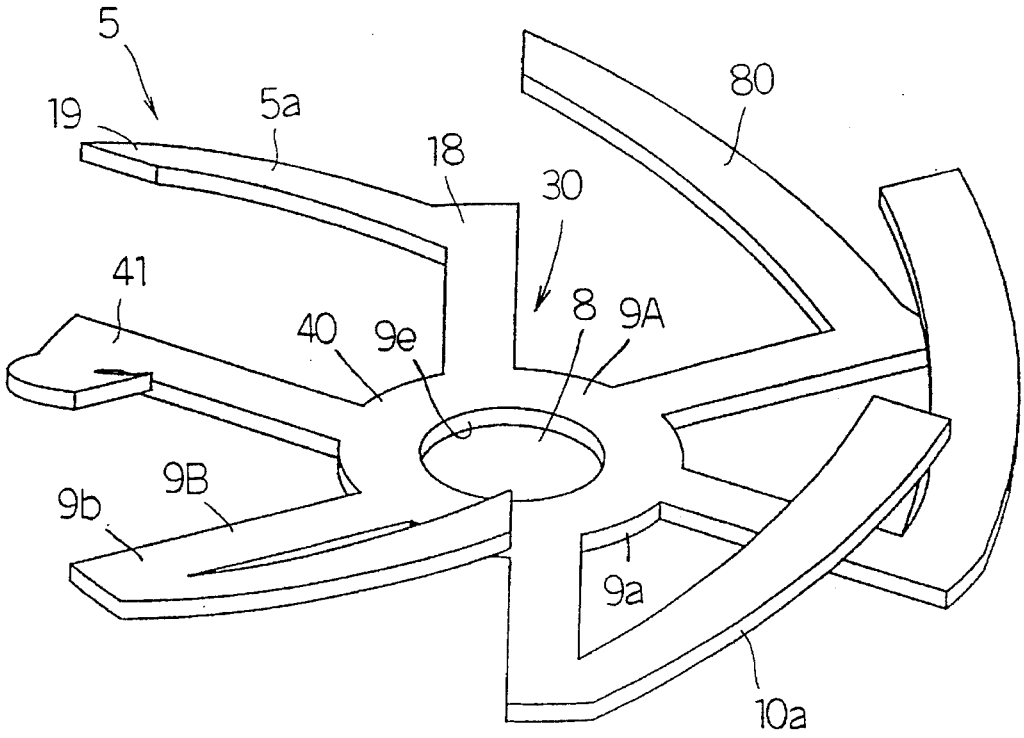
FIG. 15 is a perspective view of a second type of rotating vane assembly having six spokes.
Figure 16:
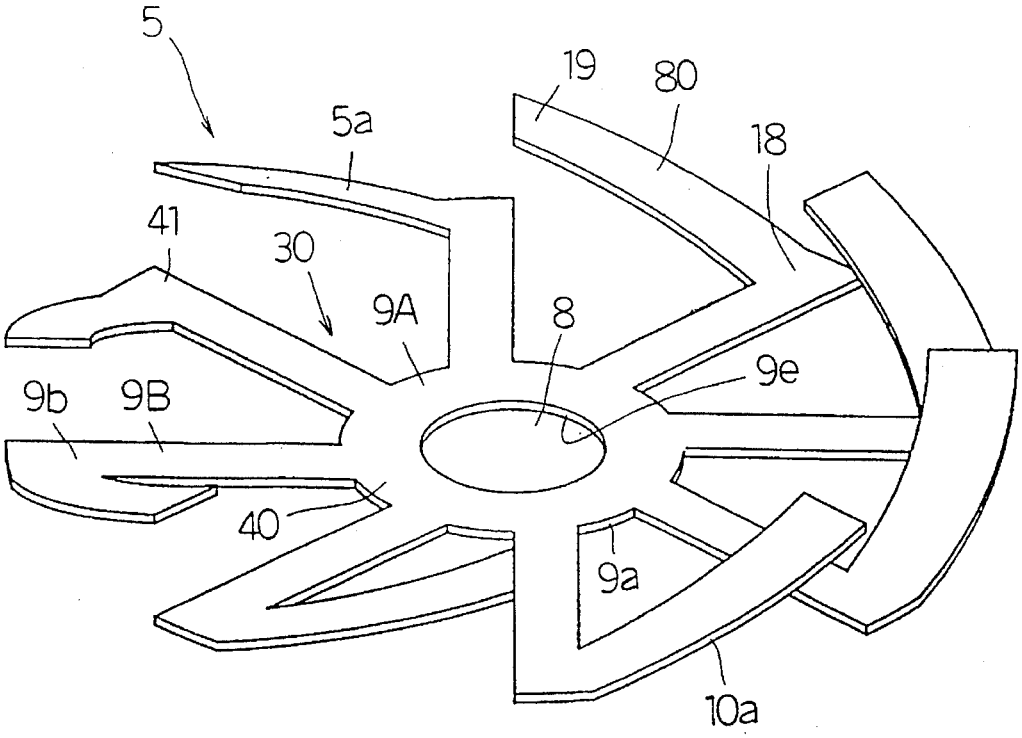
FIG. 16 is a perspective view of a second type of rotating vane assembly having eight spokes.
Figure 17:
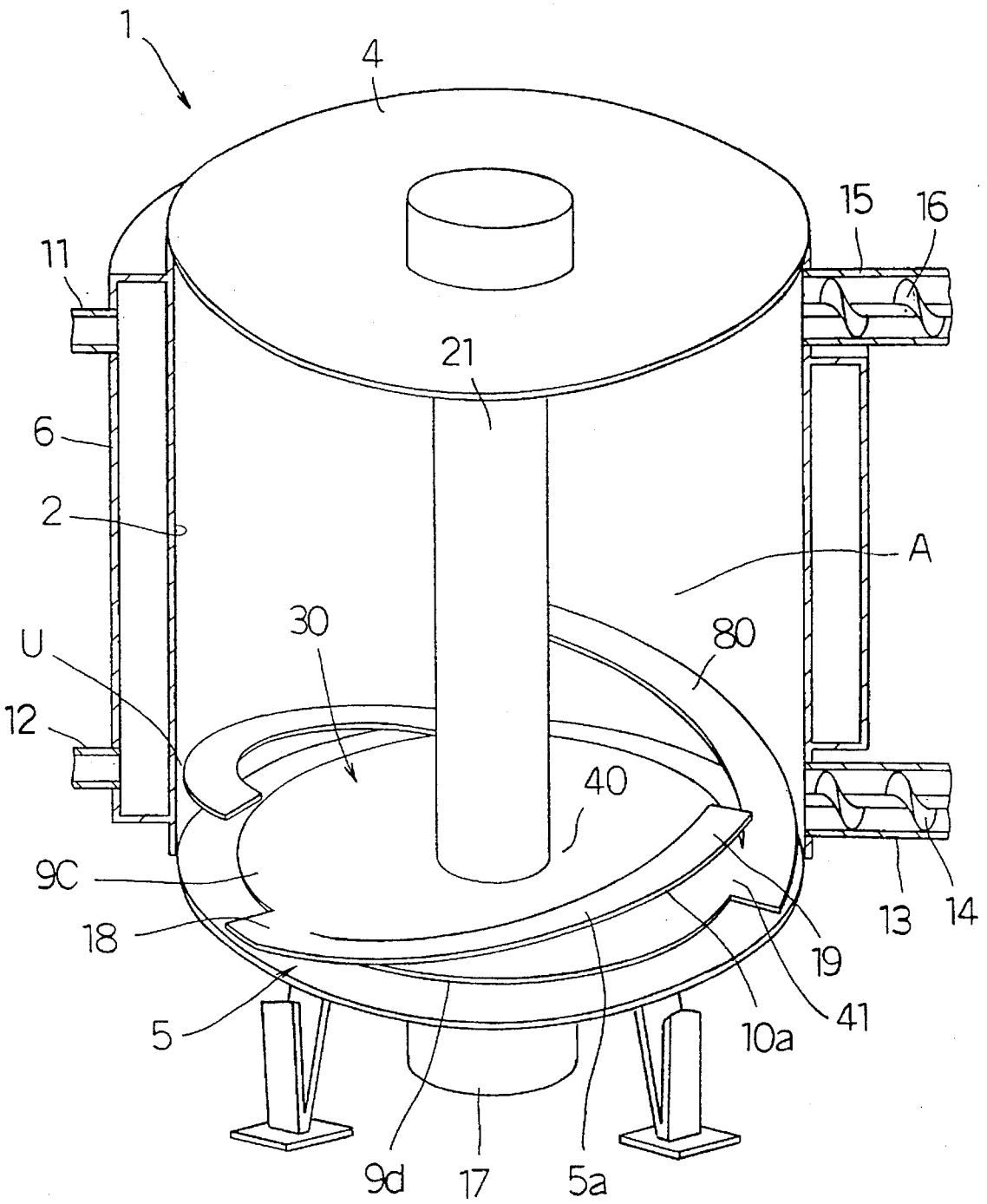
FIG. 17 is a perspective view of a single-stage drying apparatus according to a fourth embodiment, shown partly in section.
Figure 18:
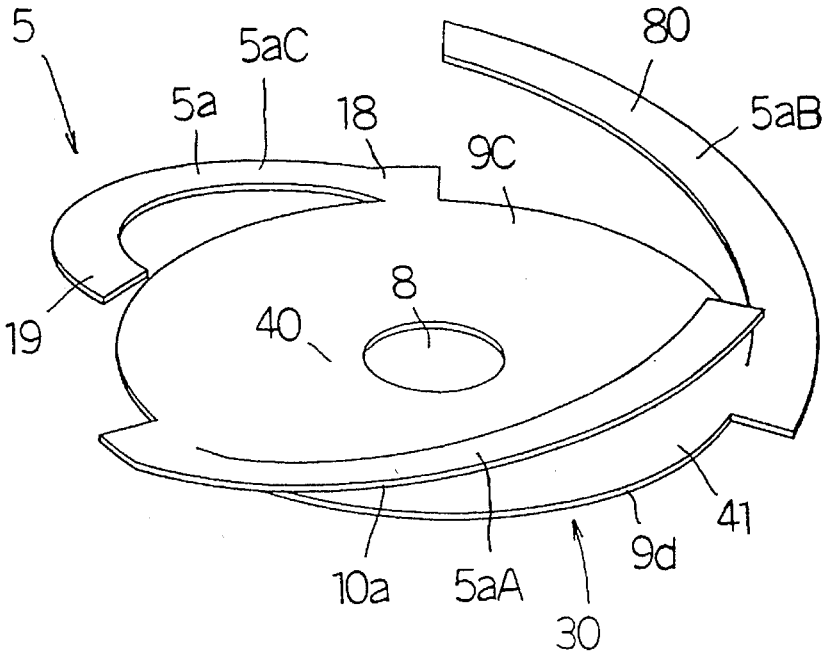
FIG. 18 is a perspective view of a third type of vane assembly having three circular-arc vane sections.
Figure 19:
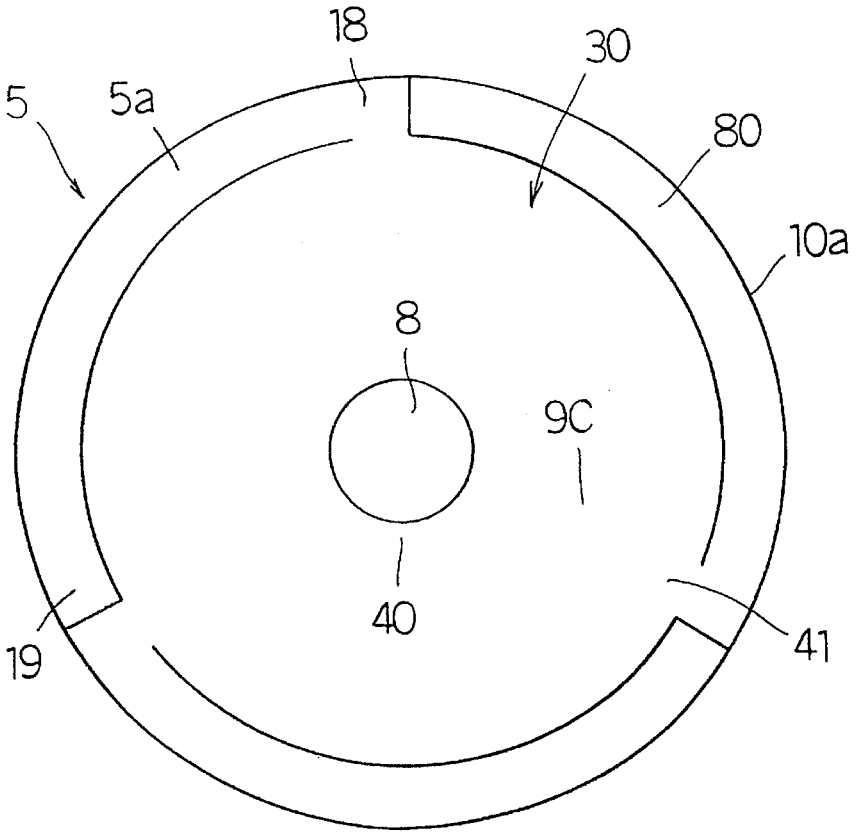
FIG. 19 is a plane view of the vane assembly of FIG. 18.

FIGS. 14, 15 and 16 show similar vane assemblies having four, six and eight radial arms 9B and circular-arc vane sections 5*a* respectively. Such a vane assembly 5 may have radial arms and vane sections as many as required.

Figure 20:
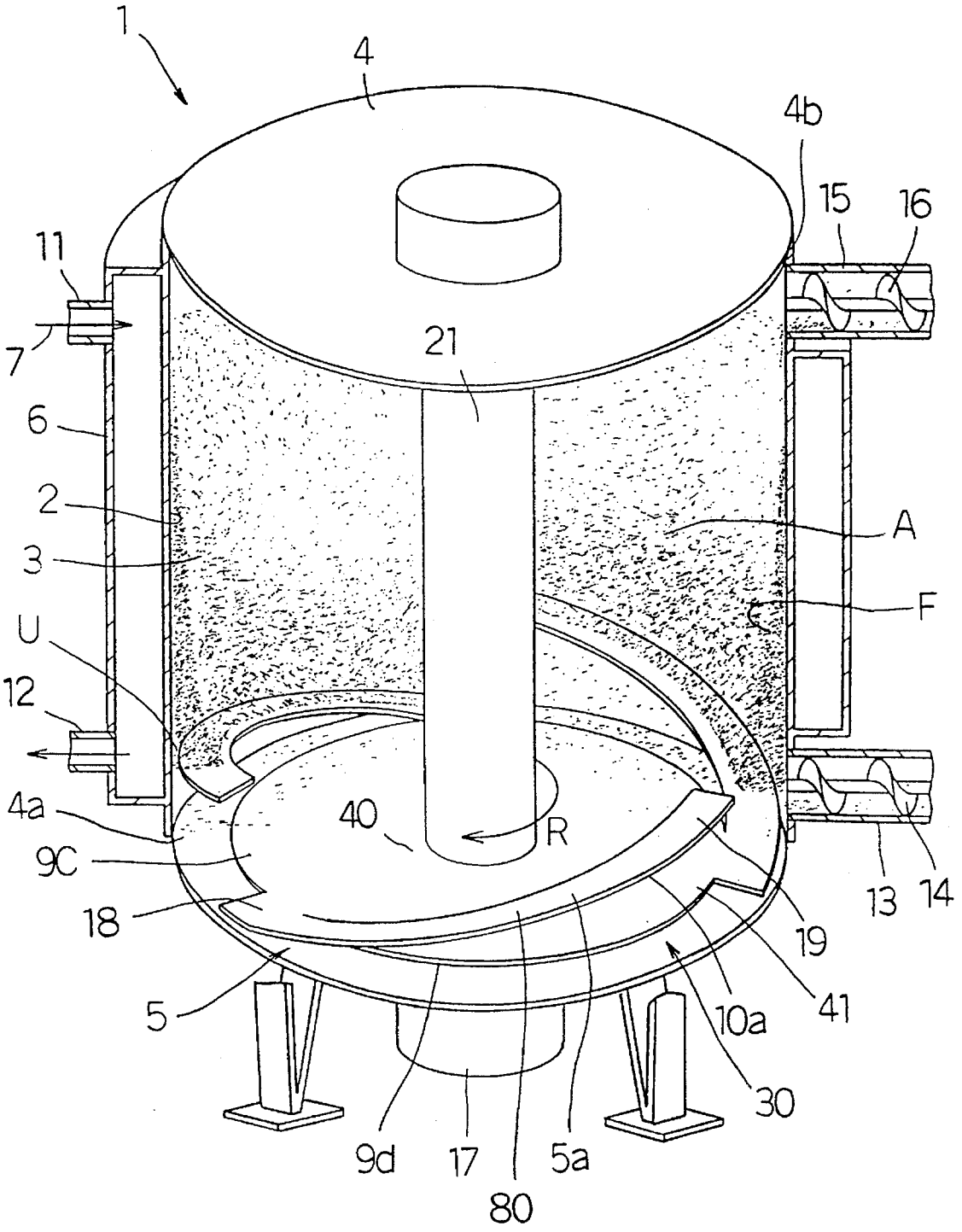
FIG. 20 is a perspective view of the single-stage drying apparatus of FIG. 17, showing how it works.
Figure 21:
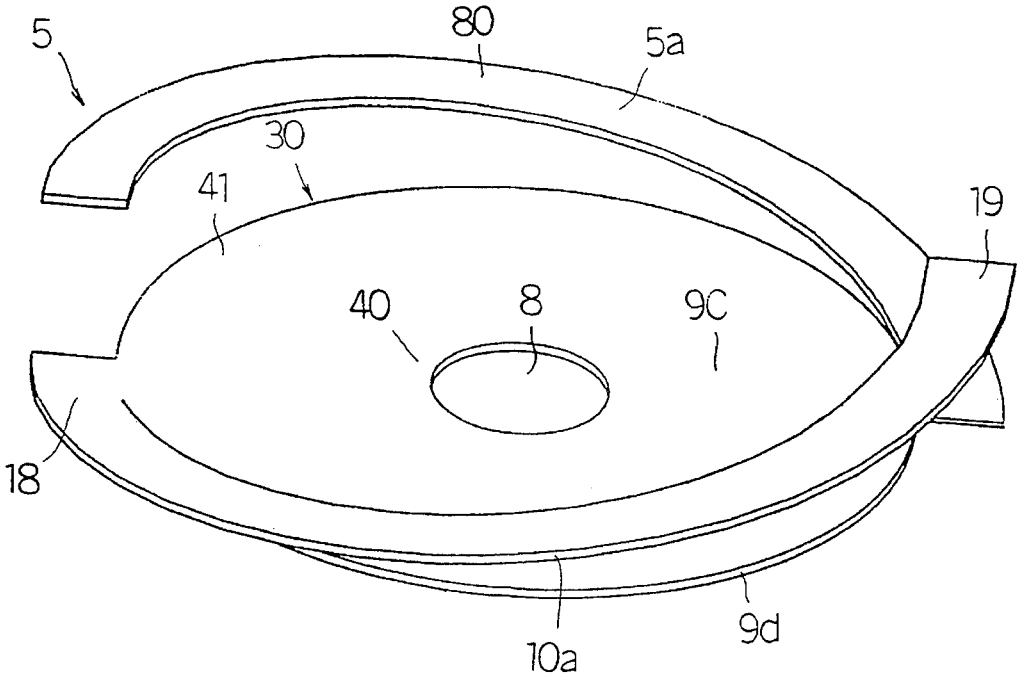
FIG. 21 is a perspective view of a third type of rotating vane assembly having two circular-arc vane sections.

Referring to FIGS. 17 to 20, still another single-stage drying apparatus is shown as having a circular vane assembly, which comprises a circular support 30 having three circular-arc vane sections 5aA, 5aB and 5aC integrally connected to its circumference 9*d* as indicated at 18. FIG. 20 shows how it works.

Figure 22:
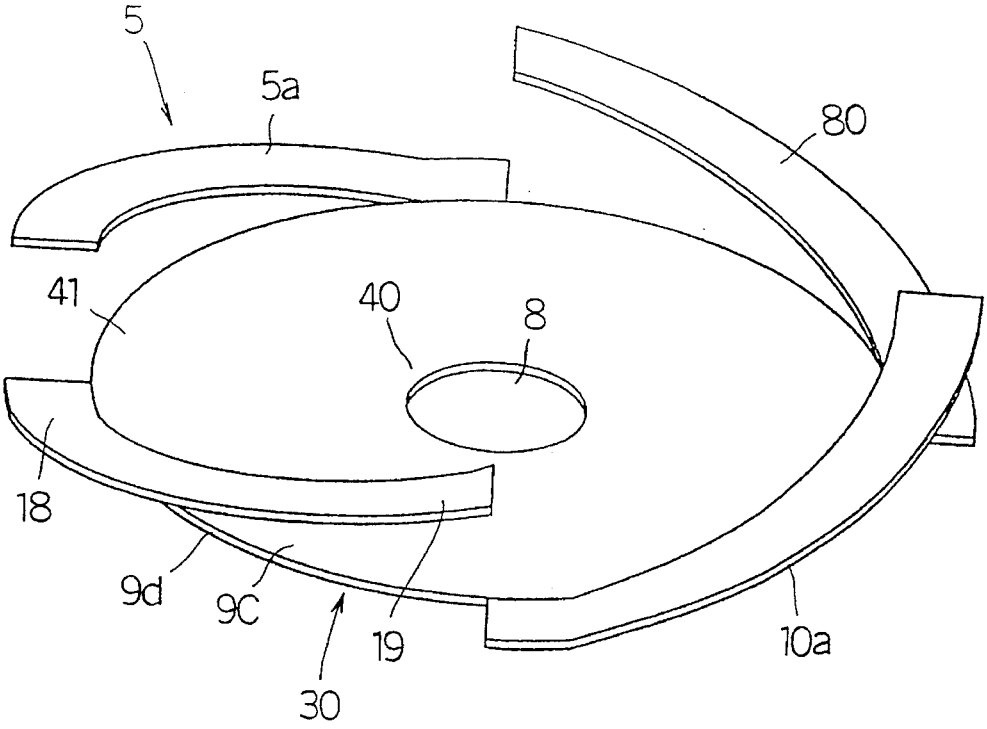
FIG. 22 is a perspective view of a third type of rotating vane assembly having four circular-arc vane sections.
Figure 24:
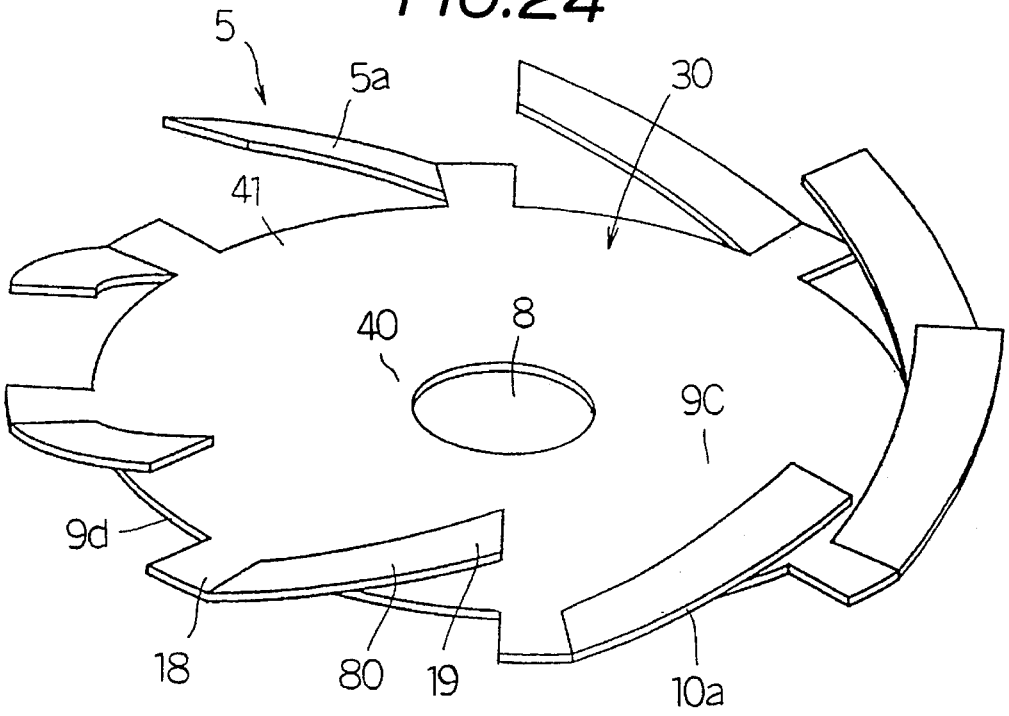
FIG. 24 is a perspective view of a third type of rotating vane assembly having eight circular-arc vane sections.
Figure 25:
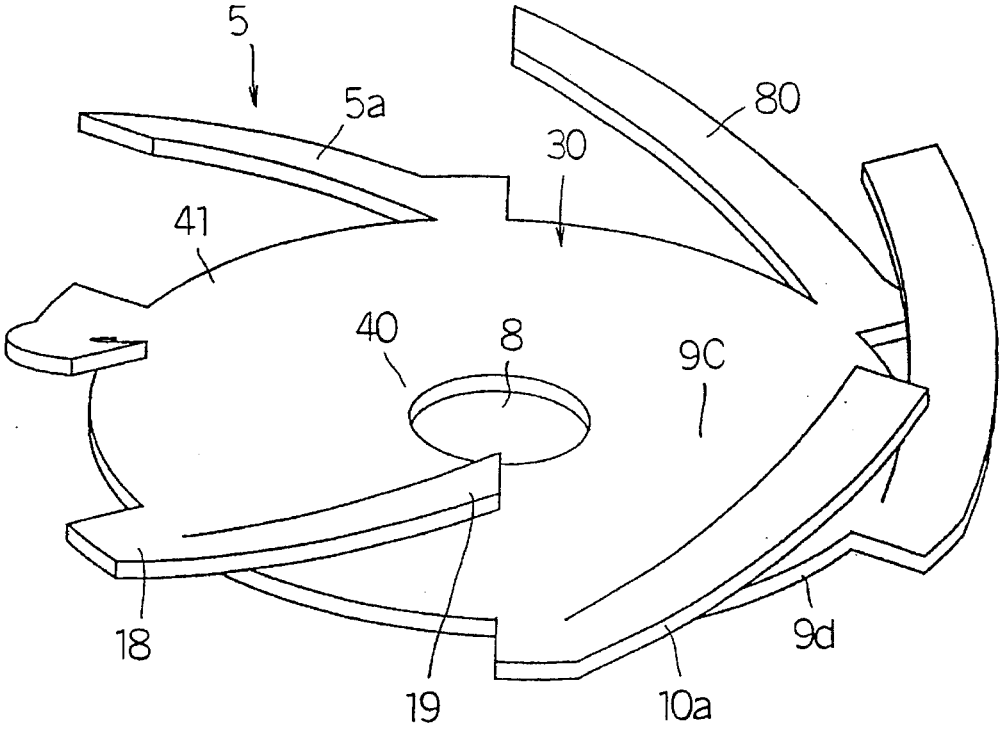
FIG. 25 is a perspective view of a third type of rotating vane assembly having six circular-arc vane sections.

FIG. 22 shows a similar circular vane assembly 5, which comprises a circular support 40 having four circular-arc vane sections 5*a* integrally connected to its circumference 9*d* as indicated at 18. FIGS. 24 and 25 show similar vane assemblies 5 having eight and six circular-arc vane sections respectively.

Figure 23:
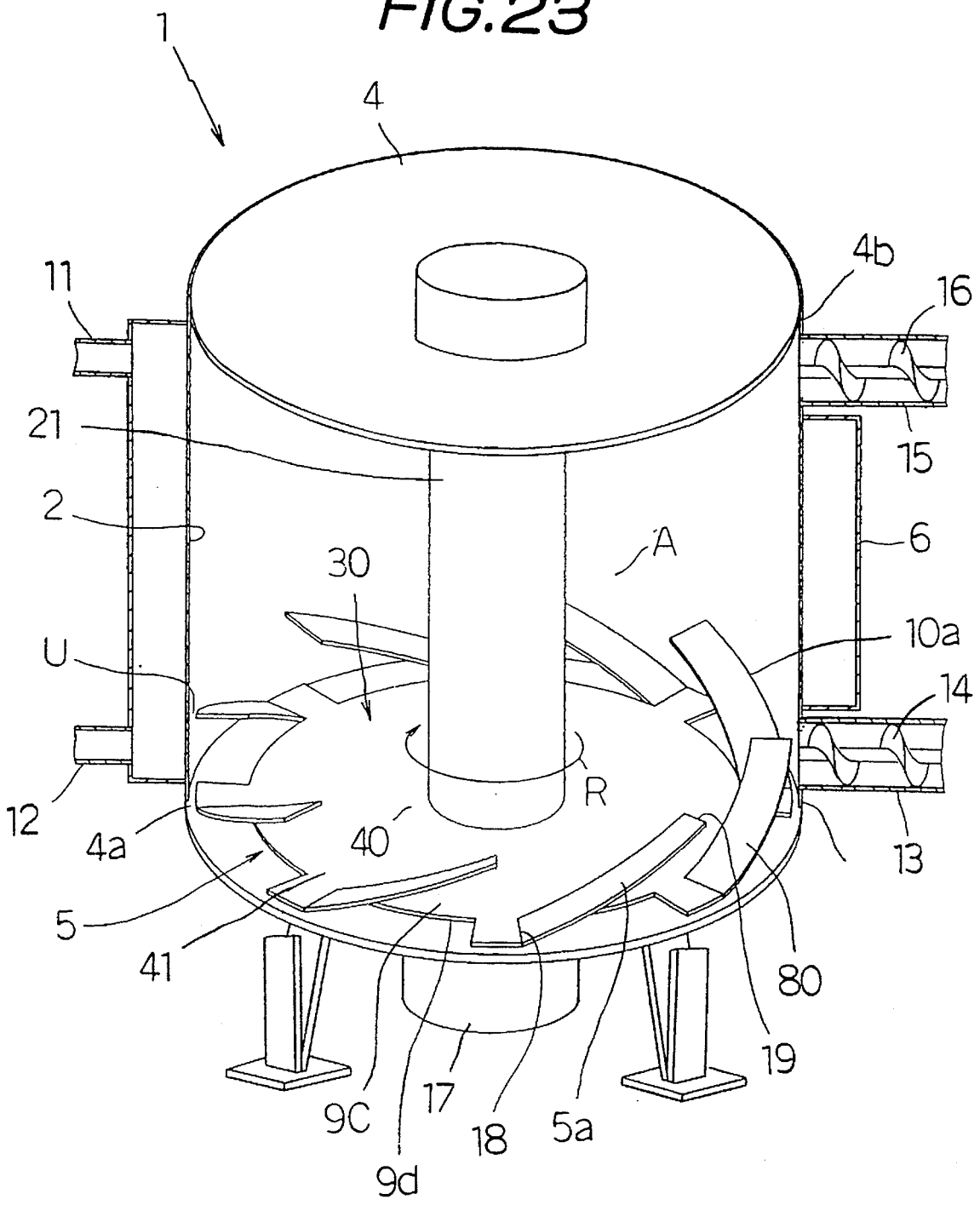
FIG. 23 is a perspective view of a single-stage drying apparatus according to a fifth embodiment, shown partly in section.

Referring to FIG. 23, a still another single-stage drying apparatus is shown as using a circular vane assembly having eight circular-arc vane sections.

Figure 26:
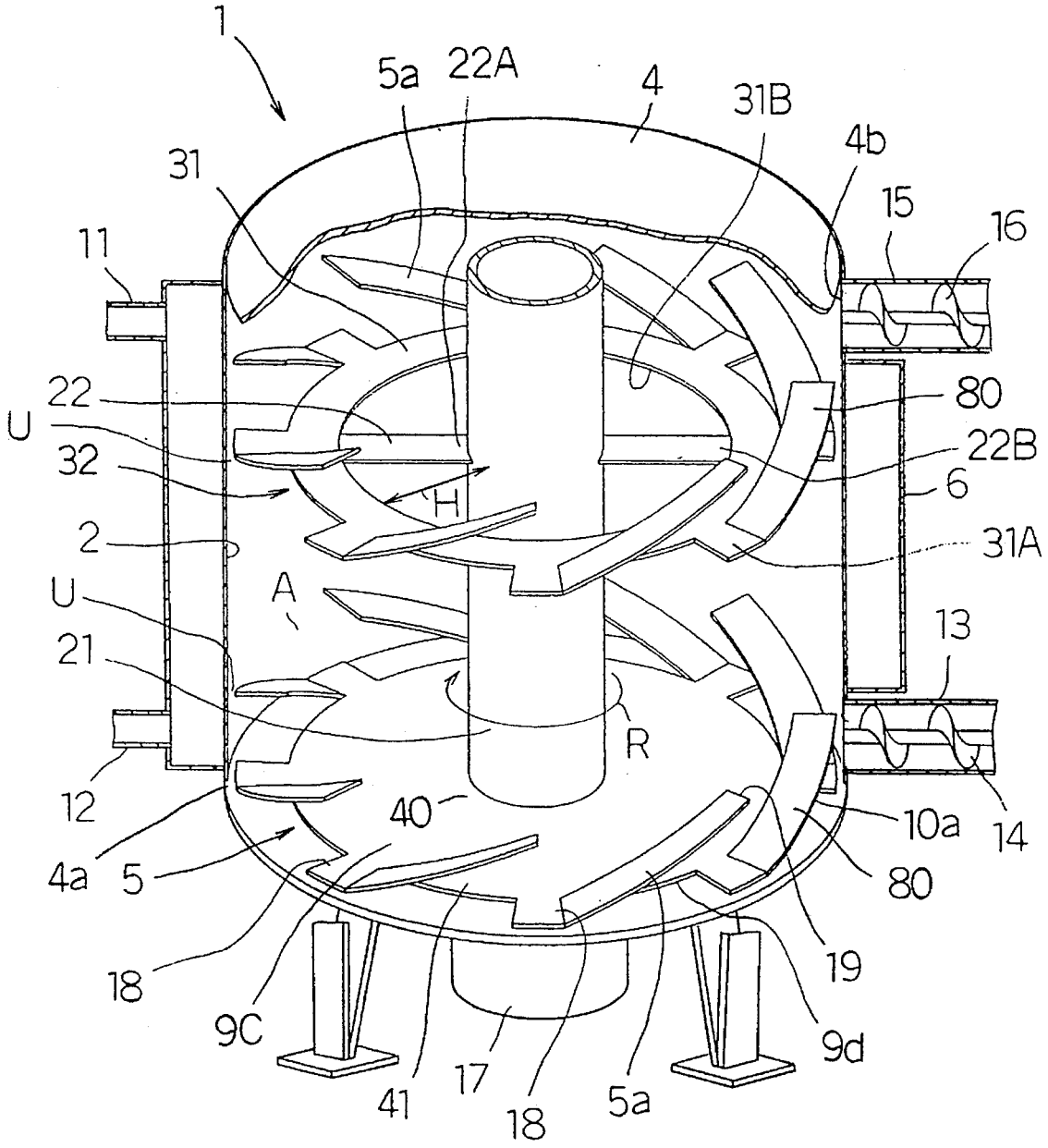
FIG. 26 is a perspective view of a multi-stage drying apparatus according to a fifth embodiment according to the present invention, shown partly in section.

Referring to FIG. 26, a two-stage drying apparatus uses a circular vane assembly at a lower level and a broken wheel-like vane assembly at an upper level. The broken wheel-like vane assembly has two radial spokes 22 and an annular vaned member integrally connected thereto. The spokes 22 radially extend a distance H from the vertical axle 21, and the annular vaned member has eight circular-arc vane sections 80. The circular vane assembly has eight circular-arc vane sections 80, too. In operation these vane assemblies are rotated, and material to be dried is spirally raised from the lower to upper vane assembly while being pushed against the heat-transmitting surface 2 of the hollow cylinder 4.

Figure 27:
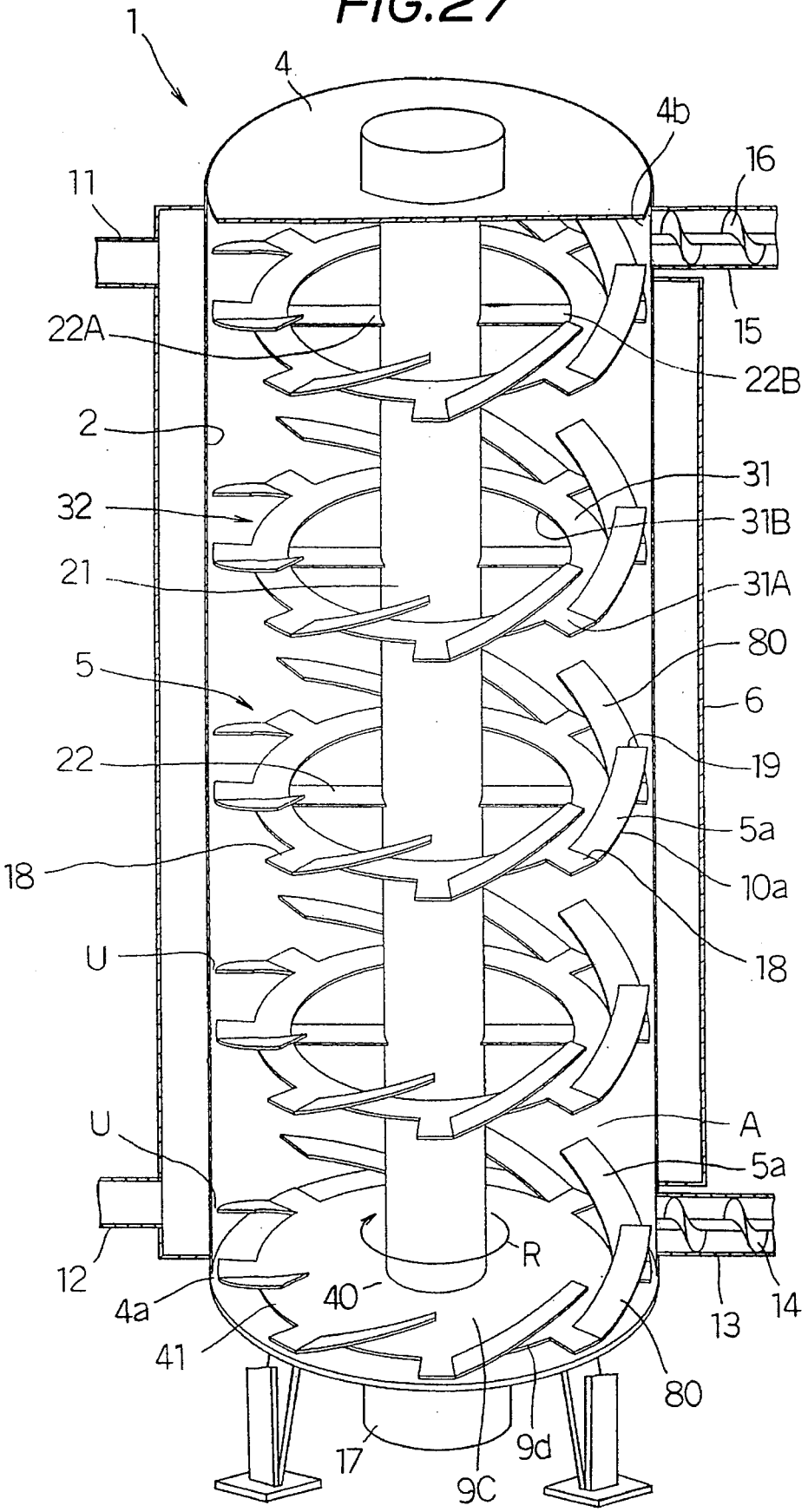
FIG. 27 is a perspective view of a multi-stage drying apparatus according to a sixth embodiment, shown partly in section.

Finally referring to FIG. 27, a five-stage drying apparatus uses a circular vane assembly at a lower level and four broken wheel-like vane assemblies at higher levels. Each vane assembly has eight vane sections. In operation these vane assemblies are rotated, and material to be dried is spirally raised up from stage to stage while being pushed against the heat-transmitting surface 2 of the hollow cylinder 4.

What is claimed is:

1. A drying apparatus comprising:

a cylindrical drying vessel for receiving material to be dried, an inner wall surface of said cylindrical drying vessel defining a heat-transmitting surface, heat-generating means encircling the cylindrical drying vessel to transmit heat to the heat-transmitting surface of the cylindrical drying vessel, and at least one rotating vane assembly rotatably fixed in the cylindrical drying vessel, the rotating vane assembly having a plurality of vane sections, which extend from a common central portion and leave between circumferential edges thereof and the heat-transmitting surface of the cylindrical drying vessel, annular spaces wide enough to allow the material to cross and contact the heat-transmitting surface without falling therein, each vane section extending obliquely upward in a direction which is opposite to a rotating direction thereof, and the circumferential edge of each vane section extending less than 360 degrees as viewed from above, whereby all vane sections when rotating bear material on upper surfaces thereof to raise the material upward and push the material against the heat-transmitting surface under the influence of centrifugal force thus causing the material to continuously climb along the heat-transmitting surface, thereby drying the material.

2. A drying apparatus according to claim 1 wherein the cylindrical drying vessel has a center rotating axle erecting on its bottom, and the center rotating axle has a plurality of rotating vane assemblies at different levels, whereby all rotating vane assemblies when rotating may raise the material so that the material may be raised from the lowest to the highest level while pushing the material against the heat-transmitting surface, thereby drying the material 3.

3. A drying apparatus according to claim 1 wherein the cylindrical drying vessel has a center rotating axle erecting on its bottom, the center rotating axle being adapted to be driven by an associated motor, and the rotating vane assembly has a center area with an opening made therein for inserting and fastening the center rotating axle to the vane assembly, a plurality of circumferential vane sections, and connecting means to integrally connect the center area to one end of each circumferential vane section.

4. A drying apparatus comprising:

a cylindrical drying vessel for receiving material to be dried, an inner wall surface of said cylindrical drying vessel defining a heat-transmitting surface, the cylindrical drying vessel having a center rotating axle erecting on its bottom, the center rotating axle being adapted to be driven by an associated motor, heat-generating means encircling the cylindrical drying vessel to transmit heat to the heat-transmitting surface of the cylindrical drying vessel, and at least one rotating vane assembly rotatably fixed in the cylindrical drying vessel, the rotating vane assembly having defined a relatively small disk having an opening defined therein for inserting and fastening the center rotating axle to the vane assembly, a plurality of circumferential vane sections, and a plurality of radial arms each extending radially from the disk and integrally connected to one end of each circumferential vane section, and annular spaces wide enough to allow the material to cross and contact the heat-transmitting surface without falling therein, each vane section extending obliquely upward in a direction which is opposite to a rotating direction thereof, and the circumferential edge of each vane section extending less than 360 degrees as viewed from above, whereby all vane sections when rotating bear material on upper surfaces thereof to raise the material upward and push the material against the heat-transmitting surface under the influence of centrifugal force thus causing the material to continuously climb along the heat-transmitting surface, thereby drying the material.

5. A drying apparatus comprising:

a cylindrical drying vessel for receiving material to be dried, an inner wall surface of said cylindrical drying vessel defining a heat-transmitting surface, the cylindrical drying vessel having a center rotating axle erecting on its bottom, the center rotating axle being adapted to be driven by an associated motor, at least one rotating vane assembly rotatably fixed in the cylindrical drying vessel, the rotating vane assembly having a relatively large disk having an opening made therein for inserting and fastening the center rotating axle to the vane assembly, a plurality of circumferential vane sections, one end of each circumferential vane section being integrally connected to the outer circumference of the relatively large disk, and annular spaces wide enough to allow the material to cross and contact the heat-transmitting surface without falling therein, each vane section extending obliquely upward in a direction which is opposite to a rotating direction thereof, and the circumferential edge of each vane section extending less than 360 degrees as viewed from above, whereby all vane sections when rotating bear material on upper surfaces thereof to raise the material upward and push the material against the heat-transmitting surface under the influence of centrifugal force thus causing the material to continuously climb along the heat-transmitting surface, thereby drying the material.

6. A drying apparatus according to claim 1 wherein the cylindrical drying vessel has a center rotating axle erecting on its bottom, and the rotating vane assembly comprises an annular member, a plurality of radial arms each extending a radial distance to integrally connect the inner circumference of the annular member to the center rotating axle.

7. A drying apparatus comprising:

a cylindrical drying vessel for receiving material to be dried, an inner wall surface of said cylindrical drying vessel defining a heat-transmitting surface, the cylindrical drying vessel having a center rotating axle erecting on its bottom, heat-generating means encircling the cylindrical drying vessel to transmit heat to the heat-transmitting surface of the cylindrical drying vessel, and at least one rotating vane assembly rotatably fixed in the cylindrical drying vessel, the rotating vane assembly having a relatively small disk having an opening made therein for inserting and fastening the center rotating axle to the vane assembly, a plurality of circumferential vane sections, a plurality of radial arms each extending radially from the disk and integrally connected to one end of each circumferential vane section, and annular spaces wide enough to allow the material to cross and contact the heat-transmitting surface without falling therein, each vane section extending obliquely upward in the direction which is opposite to the rotating direction, and the circumferential edge of each vane section extending less than 360 degrees as viewed from above, whereby all vane sections when rotating bear material on upper surfaces thereof to raise the material upward and push the material against the heat-transmitting surface under the influence of centrifugal force thus causing the material to continuously climb along the heat-transmitting surface, thereby drying the material.

8. A drying apparatus comprising:

a cylindrical drying vessel for receiving material to be dried, an inner wall surface of said cylindrical drying vessel defining a heat-transmitting surface, the cylindrical drying vessel having a center rotating axle erecting on its bottom, heat-generating means encircling the cylindrical drying vessel to transmit heat to the heat-transmitting surface of the cylindrical drying vessel, and at least one rotating vane assembly rotatably fixed in the cylindrical drying vessel, the rotating vane assembly having a relatively large disk having an opening made therein for inserting and fastening the center rotating axle to the vane assembly, and a plurality of circumferential vane sections, one end of each circumferential vane being integrally connected to the outer circumference of the relatively large disk, and annular spaces wide enough to allow the material to cross and contact the heat-transmitting surface without falling therein, each vane section extending obliquely upward in the direction which is opposite to the rotating direction, and the circumferential edge of each vane section extending less than 360 degrees as viewed from above, whereby all vane sections when rotating bear material on upper surfaces to raise the material upward and push the material against the heat-transmitting surface under the influence of centrifugal force thus causing the material to continuously climb along the heat-transmitting surface, thereby drying the material.

9. A drying apparatus as in claim 1, wherein each vane section has first and second ends at respective ends of said circumferential edge thereof, said second end being a free, upper end thereof and said first end being coupled to said common central portion and being disposed at a vertical height lower than said second end.

* * * * *